US008776272B1

(12) United States Patent
Straus et al.

(10) Patent No.: US 8,776,272 B1
(45) Date of Patent: Jul. 15, 2014

(54) HELMET COVER

(71) Applicant: Protective Sports Equipment International, Inc, Chester Springs, PA (US)

(72) Inventors: Albert E Straus, Timonium, MD (US); Frank Lytle, West Chester, PA (US)

(73) Assignee: Protective Sports Equipment International Inc., Chester Springs, PA (US)

( * ) Notice: Subject to any disclaimer, the term of this patent is extended or adjusted under 35 U.S.C. 154(b) by 0 days.

(21) Appl. No.: 13/791,813

(22) Filed: Mar. 8, 2013

Related U.S. Application Data

(60) Provisional application No. 61/608,450, filed on Mar. 8, 2012.

(51) Int. Cl.
*A42B 3/00* (2006.01)
*A63B 71/10* (2006.01)
*A42B 3/04* (2006.01)

(52) U.S. Cl.
CPC ..... *A42B 3/0406* (2013.01)
USPC ..... 2/411; 2/425

(58) Field of Classification Search
CPC ..... A42B 3/003; A42B 3/00; A42B 3/006; A42B 3/04; A42B 3/0413; A42B 3/32
USPC ..... 2/410, 422, 425, 411, 414, 4, 205
See application file for complete search history.

(56) References Cited

U.S. PATENT DOCUMENTS

| | | | | | |
|---|---|---|---|---|---|
| 3,155,981 | A | * | 11/1964 | McKissick et al. | 2/422 |
| 3,174,155 | A | * | 3/1965 | Pitman | 2/411 |
| 3,245,087 | A | * | 4/1966 | Marchello | 2/422 |
| 3,435,460 | A | * | 4/1969 | Grant | 2/422 |
| 3,445,860 | A | * | 5/1969 | Rodell | 2/422 |
| 4,106,124 | A | * | 8/1978 | Green | 2/422 |
| 4,223,409 | A | * | 9/1980 | Lee | 2/411 |
| 4,599,752 | A | * | 7/1986 | Mitchell | 2/425 |
| 4,660,230 | A | * | 4/1987 | Mayling | 2/413 |
| 4,937,888 | A | * | 7/1990 | Straus | 2/411 |
| 4,996,724 | A | * | 3/1991 | Dextrase | 2/411 |
| 5,010,598 | A | * | 4/1991 | Flynn et al. | 2/410 |
| 5,519,895 | A | | 5/1996 | Barnes, Jr. | |
| 5,522,091 | A | | 6/1996 | Rudolf | |

(Continued)

FOREIGN PATENT DOCUMENTS

WO WO2011121079 10/2011

*Primary Examiner* — Alissa L Hoey
(74) *Attorney, Agent, or Firm* — Invention To Patent Services; Alex R. Hobson

(57) ABSTRACT

A helmet cover that has an outer skin, an impact absorbing material and at least one vent comprising an aperture through the helmet cover is described. A helmet cover vent may be aligned with a vent in a helmet, thereby providing for improved ventilation and cooling, and may be attached to a helmet. A helmet cover vent may be configured as a tapered or flared vent, and may be an air capture vent. The impact absorbing material may be configured over substantially the entire helmet cover surface, or may cover only a portion of the surface. In one embodiment, the impact absorbing material is configured as a discrete pad that is located where impact is most common, such as on the front, sides, or back of the helmet cover. A discrete pad may be interchangeable, allowing for customizing the type and location of impact absorption on the helmet cover.

25 Claims, 6 Drawing Sheets

(56) References Cited

U.S. PATENT DOCUMENTS

| | | | | |
|---|---|---|---|---|
| 5,581,819 | A * | 12/1996 | Garneau | 2/421 |
| 5,628,071 | A | 5/1997 | Nezer | |
| 5,713,082 | A | 2/1998 | Bassette et al. | |
| 5,724,681 | A | 3/1998 | Sykes | |
| 5,732,414 | A | 3/1998 | Monica | |
| 5,915,537 | A * | 6/1999 | Dallas et al. | 2/410 |
| 6,029,283 | A * | 2/2000 | Comstock et al. | 2/422 |
| 6,101,636 | A * | 8/2000 | Williams | 2/410 |
| 6,154,889 | A | 12/2000 | Moore, III et al. | |
| 6,237,162 | B1 * | 5/2001 | Gill | 2/422 |
| 6,243,881 | B1 * | 6/2001 | Brinkman | 2/422 |
| 6,256,799 | B1 * | 7/2001 | McGlasson et al. | 2/422 |
| 6,272,692 | B1 * | 8/2001 | Abraham | 2/411 |
| 6,282,724 | B1 | 9/2001 | Abraham et al. | |
| 6,292,953 | B1 * | 9/2001 | Beautz | 2/422 |
| 6,314,586 | B1 | 11/2001 | Duguid | |
| 6,332,228 | B1 * | 12/2001 | Takahara | 2/422 |
| 6,772,447 | B2 * | 8/2004 | Morrow et al. | 2/424 |
| 6,804,829 | B2 * | 10/2004 | Crye et al. | 2/6.6 |
| 6,848,122 | B1 * | 2/2005 | Meeds | 2/422 |
| 6,983,488 | B2 * | 1/2006 | Foote et al. | 2/10 |
| 7,114,198 | B1 * | 10/2006 | Hsieh et al. | 2/422 |
| 7,243,378 | B2 * | 7/2007 | Desarmaux et al. | 2/423 |
| 7,254,843 | B2 | 8/2007 | Talluri | |
| 7,328,462 | B1 | 2/2008 | Straus | |
| 7,802,321 | B2 * | 9/2010 | Boyd | 2/422 |
| 7,865,976 | B2 * | 1/2011 | Beddoe et al. | 2/425 |
| 8,156,570 | B1 | 4/2012 | Hockaday | |
| 8,166,573 | B1 * | 5/2012 | Chung et al. | 2/411 |
| 8,640,267 | B1 * | 2/2014 | Cohen | 2/411 |
| 2005/0241049 | A1 * | 11/2005 | Ambuske et al. | 2/412 |
| 2005/0283885 | A1 * | 12/2005 | Stroud et al. | 2/411 |
| 2007/0107112 | A1 * | 5/2007 | Boyd | 2/410 |
| 2007/0226881 | A1 * | 10/2007 | Reinhard et al. | 2/412 |
| 2008/0052808 | A1 * | 3/2008 | Leick et al. | 2/411 |
| 2008/0083053 | A1 * | 4/2008 | Lin | 2/422 |
| 2008/0222782 | A1 * | 9/2008 | Stokes | 2/422 |
| 2008/0271227 | A1 * | 11/2008 | Mollo | 2/422 |
| 2010/0000009 | A1 * | 1/2010 | Morgan | 2/414 |
| 2011/0179557 | A1 * | 7/2011 | Rabie | 2/411 |
| 2011/0252545 | A1 * | 10/2011 | Irrgang et al. | 2/414 |
| 2011/0252547 | A1 * | 10/2011 | Leung et al. | 2/425 |
| 2011/0296593 | A1 * | 12/2011 | Dhillon | 2/410 |
| 2011/0307997 | A1 | 12/2011 | Blair | |
| 2012/0017358 | A1 * | 1/2012 | Princip et al. | 2/414 |
| 2012/0151663 | A1 * | 6/2012 | Rumbaugh | 2/411 |
| 2012/0192337 | A1 | 8/2012 | Divine et al. | |
| 2012/0233745 | A1 * | 9/2012 | Veazie | 2/413 |
| 2013/0031692 | A1 * | 2/2013 | Wratten | 2/6.6 |
| 2013/0031700 | A1 * | 2/2013 | Wacter et al. | 2/411 |
| 2013/0205479 | A1 * | 8/2013 | Van Waes | 2/422 |
| 2013/0283504 | A1 * | 10/2013 | Harris | 2/411 |
| 2013/0340149 | A1 * | 12/2013 | Richwine | 2/422 |
| 2014/0000012 | A1 * | 1/2014 | Mustapha | 2/414 |
| 2014/0075652 | A1 * | 3/2014 | Hanson et al. | 2/411 |

* cited by examiner

HELMET COVER

CROSS-REFERENCE TO RELATED APPLICATIONS

This application claims priority from U.S. Provisional Application No. 61/608,450 filed on Mar. 8, 2012, entitled HELMET COVER, and incorporated herein in its entirety by reference.

BACKGROUND OF THE INVENTION

1. Field of the Invention

The present invention relates to detachably attachable helmet covers having vents configured therein.

2. Background

Repetitive impact to the head can lead to very serious and long term injuries and related issues. Research in this field is raising awareness of Chronic Traumatic Encephalopathy (CTE), a progressive degenerative disease, diagnosed post-mortem in individuals with a history of multiple concussions and other forms of head injury. Football players, boxers, and other athletes that sustain repetitive impacts to the head may be susceptible to this very serious condition. Therefore, it is important that measures be taken to protect athletes, to reduce their risks.

Helmet covers having impact absorbing materials have been described, however, they lack adequate versatility for various sports and in particular, lack ventilation means which may lead to athletes becoming overheated. Many athletes may decide not to use a helmet cover because they are too heavy, cannot be configure to their particular sport, or because they don't have adequate ventilation. A helmet may have vents to allow air to move into the helmet and actively cool a player's head. In addition, vents may allow for heat from the athlete's head to escape, thereby providing passive cooling.

There exists a need for a helmet cover that comprises impact absorbing material and comprises vents to allow for air flow from the helmet, through the helmet cover. Furthermore, there exists a need for a helmet cover that can be quickly and easily detached, and reattached to a helmet.

SUMMARY OF THE INVENTION

The invention is directed to a helmet cover that has an outer skin, an impact absorbing material and at least one vent comprising an aperture through the helmet cover. The impact absorbing material may be configured over substantially the entire helmet cover surface, or may cover only a portion of the helmet surface. In one embodiment, the impact absorbing material is configured as a discrete pad, in locations where impact is most common, such as on the front, sides, or back of the helmet. The impact absorbing material may be configured under the outer skin, or partially under the outer skin. There may be areas were the outer skin is absent and the impact absorbing material may be exposed to, or serve as, the outer surface of the helmet cover. In other embodiments, the impact absorbing material may be a discrete pad that may be interchanged or replaced as required. For example, a linesman in football may choose to install a thicker more impact absorbing, discrete pad in the front of the helmet where he sustains impact with almost every play. The linesman may choose to have thinner or less impact absorbing material in other portions of the helmet. Likewise, an ice hockey player that may sustain impact to the back of the head when they fall, may choose to have a thicker, or more energy absorbing discrete impact material on the back of his/her helmet. A higher impact absorbing material may be thicker or perhaps heavier than a lower impact absorbing material and therefore, an athlete or user of the helmet cover may select the type and location of impact absorbing material for their sport. Discrete interchangeable pads may comprise different types of impact absorbing materials. For example, foams of different density or pads that may comprise different types of material may provide options for discrete interchangeable pads. In addition, a discrete pad may comprise an outer and/or inner skin layer.

An impact absorbing material, as used herein, is defined as a compressible material that may be used to disperse, dampen, and/or dissipate an impact and includes, but is not limited to, elastomeric materials, open and closed cell foam materials, pleated fabrics, fabrics, gels, or gel filled pouches, composite materials and the like. The impact absorbing material may be a resilient impact absorbing material that effectively returns substantially to its original shape after being compressed and deformed. Alternatively, the impact absorbing material may be a non-resilient impact absorbing material that does not return to its original shape after being compressed and deformed, such as styrofoam.

The impact absorbing material may have any suitable thickness including, but not limited to greater than about 1 cm, greater than about 2 cm, greater than about 3 cm, greater than about 4 cm, greater than about 6 cm, greater than about 8 cm and any range between and including the thickness values provided. In one embodiment, the thickness of the impact absorbing material is relatively uniform over the surface of the helmet, not including openings and vents. In another embodiment, the thickness of the impact absorbing material may be varied from location to location, whereby a helmet cover may be adapted for a particular sport or activity. In addition, as previously described, the impact absorbing material may be a discrete pad that may be available in a variety of thicknesses.

The helmet cover, as described herein, may comprise an inner skin, whereby the impact absorbing material may be configured between the inner and outer skins. The outer skin of the helmet cover may be any suitable material and is preferably a thin, tough, hard plastic that can withstand impact without breaking or splitting. The outer skin and/or inner skin may comprise any suitable material including plastic, epoxy, elastomer, metal, composite materials and the like. In a preferred embodiment, the outer skin comprises a polyurethane. The outer skin may be attached to the impact absorbing material through any suitable means including, but not limited to, adhesives, fasteners, welds, clips, snaps, hook and loop fasteners and the like. In one embodiment, the outer skin is an integral outer skin, whereby the outer skin is formed with, and is integrally attached to, the impact absorbing material. For example, a mold in the shape of a helmet cover may be filled with a polyurethane composition that forms a thin hard skin along the interface surface with the mold, but otherwise forms a compressible foam, or impact absorbing material. When the helmet cover is removed from the mold, the integral skin is integrally attached to the foam or impact absorbing material.

The helmet cover, as described herein, may be configured to be detachably attached to a helmet. Any suitable attachment feature may be used to attach the helmet cover to a helmet including, but not limited to, adhesives, fasteners, elastic bands, welds, clips, snaps, hook and loop fasteners and the like. In one embodiment, an attachment feature comprises an integral extension of an inner or outer skin that may be configured as attachment tabs. For example, the outer skin of the helmet cover may extend beyond the impact absorbing material and be configured to fold into an opening or around the edge of the helmet. The integral extension or tab may comprise a snap, one side of a hook and loop fastener or the like, for attaching the helmet cover to the helmet. The helmet may comprise a corresponding attachment element for securing the helmet cover to the helmet. For example, a helmet cover may comprise an integral extension inner skin having the hook side of a hook and loop fastener, and the inside edge of a helmet may comprise the loop side of the hook and loop fastener, enabling the helmet cover to be quickly and easily attached and detached from a helmet. In an alternative embodiment, the helmet cover may be more permanently attached to a helmet with an adhesive or fasteners, for example.

The helmet cover, as described herein, may comprise at least one vent. A vent may be configured to align with a vent in the helmet, thereby forming an aligned vent that extends through the helmet cover and the helmet. An aligned vent, as defined herein, is a vent in a helmet cover having an inner surface opening that overlaps with at least a portion of a vent in a helmet when the helmet cover is attached to the helmet. More simply stated, it aligns with a vent in the helmet.

The helmet cover, as described herein, may comprise any suitable number of vents including, but not limited to, at least one, at least two, at least three, at least four, at least five, at least six, at least eight, ten or more, and any range between and including the number of vents provided. In one embodiment, a helmet cover comprises two vents on the top of the helmet and a vent on either side of the helmet, for four vents total.

A vent may have any suitable shape and size and may be round, oblong, oval, or any other shape. The open area or size of the opening of a vent on the outside or inside surface may have any suitable area including, but not limited to, greater than about 2 $cm^2$, greater than about 3 $cm^2$, greater than about 4 $cm^2$, greater than about 5 $cm^2$, greater than about 8 $cm^2$, greater than about 10 $cm^2$, greater than about 15 $cm^2$, and any range between and including the areas provided. A vent may have a relatively constant cross sectional area through the thickness of a helmet cover, or may be tapered or flared. A tapered vent has a larger open area on the outside surface of the helmet cover, than the open area on the inside surface of the helmet cover. A flared vent has a smaller open area on the outside surface of the helmet cover, than the open area on the inside surface of the helmet cover. A tapered vent may funnel more air into a helmet, and a flared vent may allow for more heat to escape from a user's head.

A vent may be configured as an air capture vent, wherein the vent opening on the outside surface of the helmet cover is not planar with the outer surface of the helmet cover. For example, a vent on the top of a helmet cover may have a front opening on the outside surface of the helmet cover with a front side or leading opening edge that is recessed from a backside or trailing opening edge. In this way, air moving over the outer surface of the helmet cover is more likely to be funneled into the vent opening.

The helmet cover, as described herein, may comprise an outer surface flow channel feature, or a recess in the contour of the outer surface of the helmet cover. In one embodiment, an outer flow surface flow channel may be configured with a vent. For example, a vent may be configured at the trailing end of an outer flow channel feature, and may further be an air-capture vent. An outer surface flow channel feature may have any suitable shape and configuration, and in one embodiment the leading width is larger than the trailing width.

The helmet cover, as described herein, may comprise at least one inner surface flow enhancer feature, or a protrusion, recess, or channel configured on the inner surface, and extending along at least a portion of the inner surface. An inner flow enhancer feature may comprise a plurality of recess or protrusions that extend to an inner surface open area of a vent. An inner surface flow enhancer feature may extend to the leading edge of a helmet cover, where by air enter the flow enhancer feature at the leading edge of the helmet and flow between the helmet cover and helmet. In one embodiment, an inner surface flow enhancer feature extends from the leading edge of a helmet cover to a trailing edge of the helmet cover.

In one embodiment, the helmet cover comprises an outer and inner skin with an impact absorbing material configured there between, and a plurality of air capture vents comprising an aperture through the helmet cover.

The helmet cover or helmet comprising said helmet cover, described herein, may be configured for use with any suitable type of helmet including, but not limited to, sports and recreational activity helmets, impact sport helmets, team impact sport helmets, military helmets, emergency personal helmets, protective services helmets, such as riot police helmets, industrial work helmets, children's helmets, special needs helmets and the like.

The summary of the invention is provided as a general introduction to some of the embodiments of the invention, and is not intended to be limiting. Additional example embodiments, including variations and alternative configurations of the invention, are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
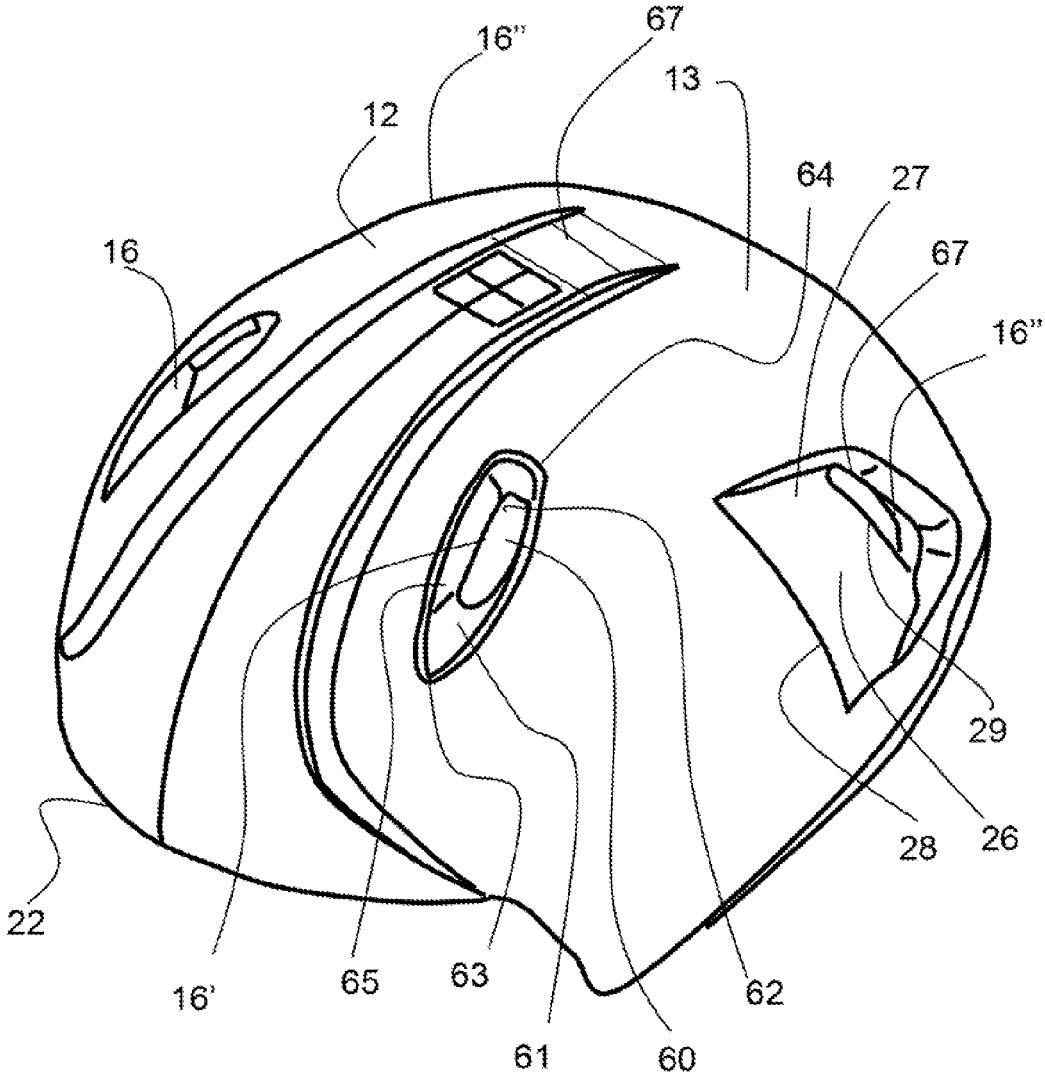

FIG. 1 shows an isometric view of n exemplary helmet cover having a plurality of vents.

Figure 2:
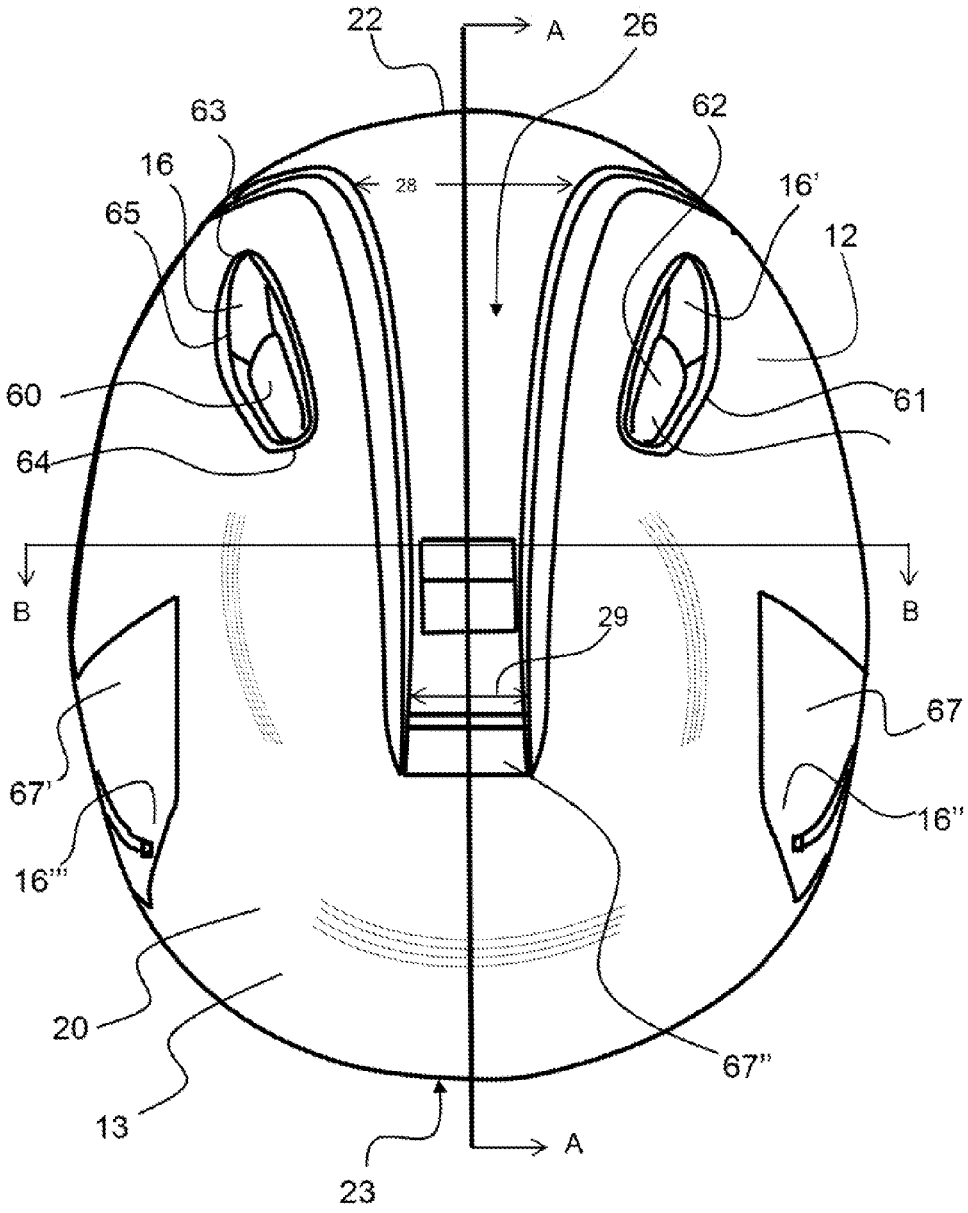

FIG. 2 shows a top down view of the exemplary helmet cover shown in FIG. 1, having a plurality of vents.

Figure 3:
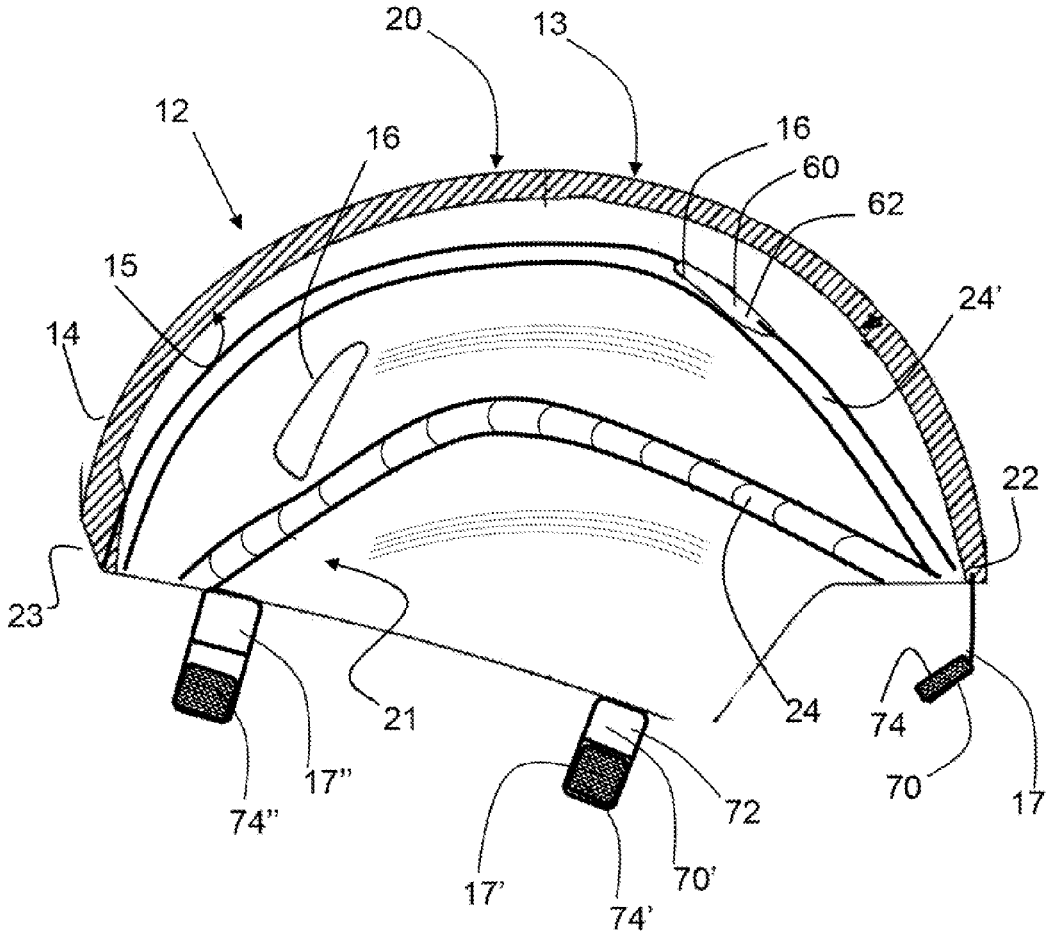

FIG. 3 shows a cut-away side view the inner surface of an exemplary helmet cover having attachment features and inner surface flow enhancer features.

Figure 4:
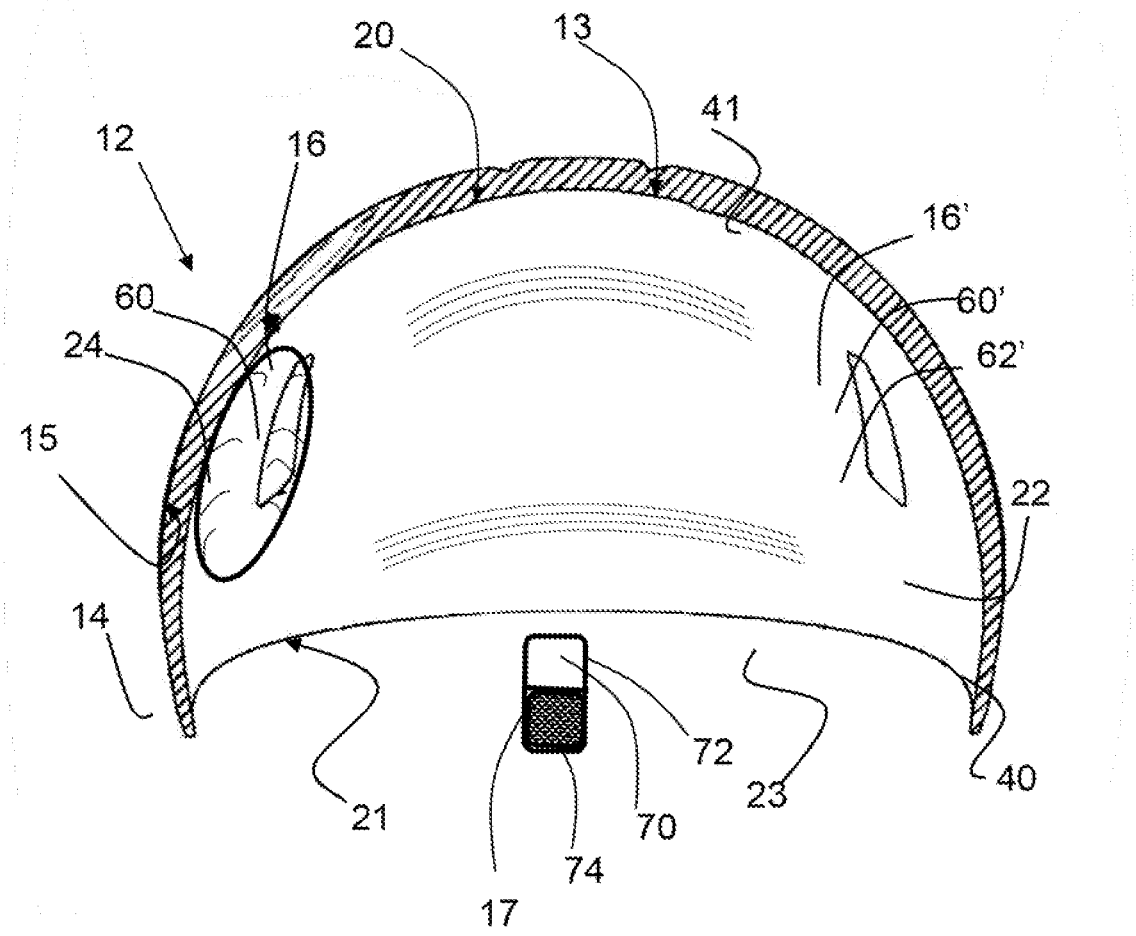

FIG. 4 shows a cut-away view of an exemplary helmet cover having an attachment feature and an inner surface flow enhancer feature.

Figure 5:
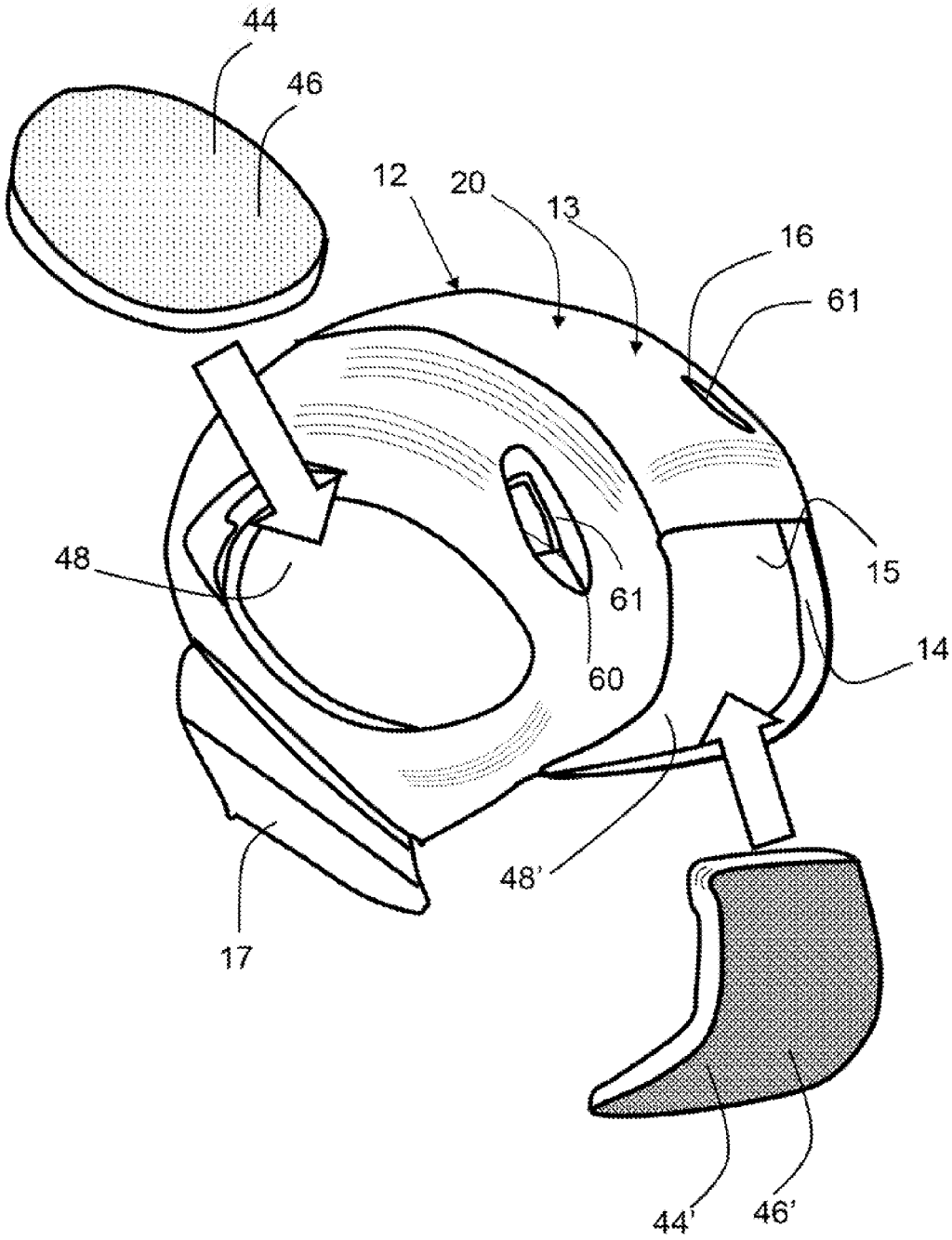

FIG. 5 shows an isometric view of an exemplary helmet cover having a interchangeable pads.

Figure 6:
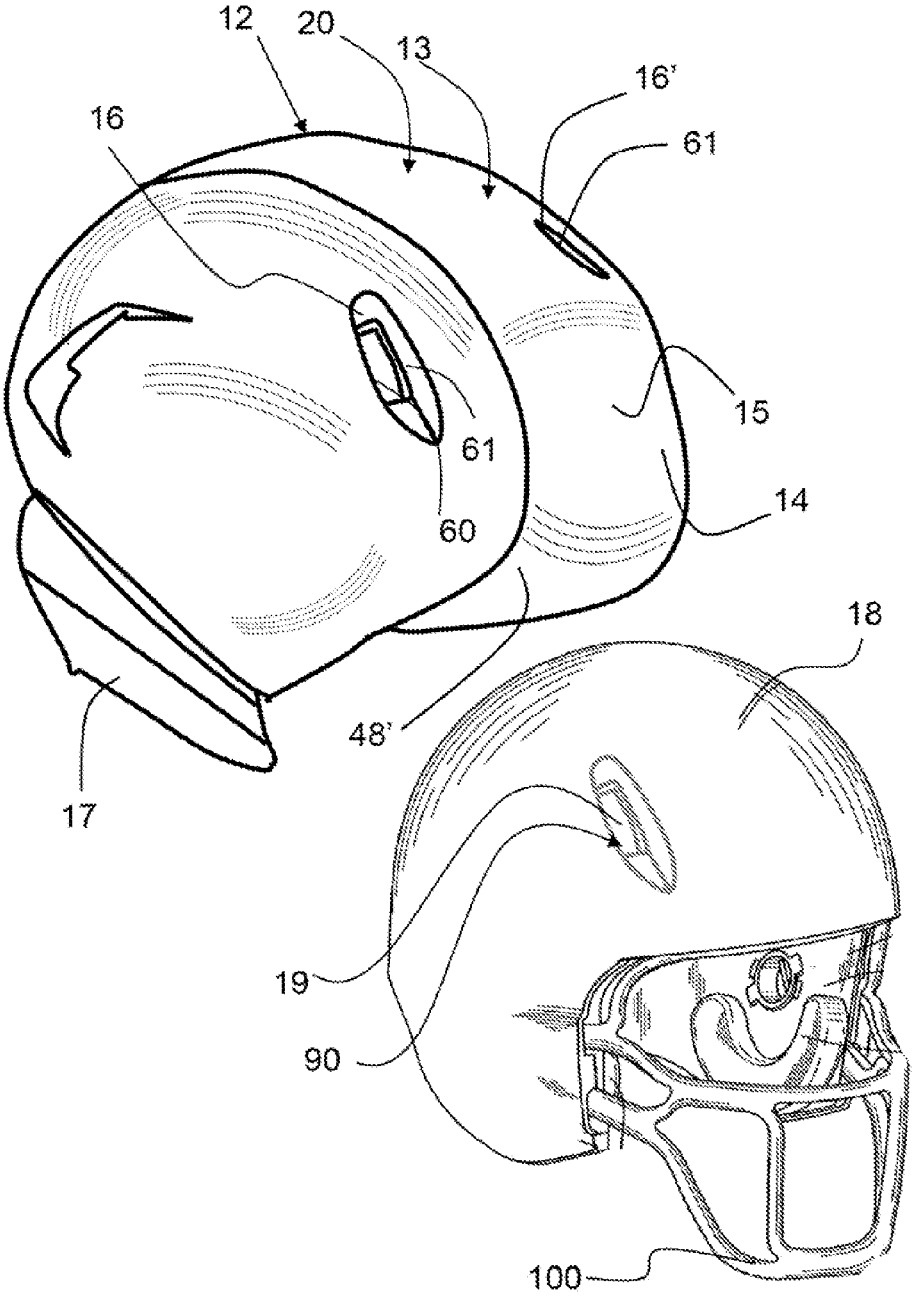

FIG. 6 shows an isometric view of an exemplary helmet cover having a vent opening configured to at least partially align with a vent opening in a helmet.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

U.S. Pat. No. 7,328,462, to Albert E. Straus and entitled Protective Helmet, '462, is hereby incorporated by reference in its entirety. The present invention contemplates the use of helmets disclosed in '462 comprising an outer layer comprising the helmet cover as described herein having at least one vent comprising an aperture through said helmet cover. The helmet cover, as described herein, may be an integral part of a helmet, such as a helmet described in '462 and may be permanently attached to the outside surface of a hardened shell. The helmet cover may be attached to any suitable type of base helmet, thereby forming an inventive helmet, as described herein.

DEFINITIONS

Impact sports, as used herein, is defined as any sports where impact with another player, sport equipment, or the ground is common, such as football, field hockey, lacrosse, ice hockey, rugby, boxing, mixed martial arts, baseball, bicycling, mountain biking, skateboarding, roller skating, ice skating, horseback riding, racquetball, wrestling, lacrosse, paintball, soccer, climbing, jet skiing, rafting, kayaking, snow skiing, snowboarding, and the like. Team impact sport refers to impact sports played by two or more players against another team and are typically played in a fixed space, such as a field or court.

Vent, as used herein, is defined as an aperture through a helmet cover that extends from the outer surface to the inner surface.

Impact absorbing material, as used herein, is defined as a compressible material that may be used to disperse, dampen, or dissipate an impact and includes, but is not limited to, elastomeric materials, open and closed cell foam materials, pleated fabrics, fabrics, composite materials and the like. The impact absorbing material may be a resilient impact absorbing material that effective returns to an original shape after being compressed and deformed. Alternatively, the impact absorbing material may be a non-resilient impact absorbing material that does not return to an original shape after being compressed and deformed, such as styrofoam.

Partially aligned, as used herein, in reference to a helmet cover vent and a helmet vent, means that the helmet cover vent aperture at least partially overlays a helmet vent, thereby allowing for air flow through the helmet cover and the helmet.

Tapering vent, as used herein, means that a vent aperture is larger in area at the outer surface of the helmet cover than at the inner surface of the helmet cover.

Flared vent, as used herein, means that a vent aperture has a smaller area at the outer surface of the helmet cover than at the inner surface of the helmet cover.

Air capturing vent, as used herein, means that the vent is configured to capture air as it passes over the outer surface of the helmet cover, and may comprise an aperture that is not planar to the outer contour of the helmet cover, and/or may comprise a vent leading edge that is recessed, and/or a trailing edge that is elevated from the contour of the helmet cover.

Non-planar, as used herein in reference to a vent aperture on an outer surface of a helmet cover, means that the aperture is not planar with the contour of the helmet and thereby is configured to capture air as it passes over the helmet cover. A non-planar vent does not follow the contour of the outer surface of the helmet cover, and may comprise one or more protruding or recessed features. Describe a different way, the leading edge of a non-planar vent aperture may be recessed, or a trailing edge of a non-planar vent aperture may be raised from the contour of the helmet cover.

Edge of a helmet, as used herein, means the perimeter of the head insertion opening of the helmet.

As shown if FIG. 1, an exemplary helmet cover 12, comprises a plurality of vents, 16. Two vents 16 and 16' are configured in the top, toward the or leading edge 22 of the helmet cover 12 and the two vents, 16" and 16''' (not shown in this view) are configured on the sides. As shown on vent 16', an aperture 60 is configured through the helmet cover. Vent 16' has an outer surface open area 61 that is larger than the inner surface open area 62, making vent 16' a tapered vent 65. The leading edge 63 of vent 16' comes to a point, whereas the trailing edge 64 is rounded. Any suitable shape of vent or aperture may be used. A flared vent would have an inner surface open area that is larger than the outer surface open area. The side vents 16" and 16''' are configured as air capture vents, wherein it is configured to capture air as it passes over the outer surface of the helmet cover. The leading edge width 28 of the aperture on vent 16" is larger than the trailing width 29 of the aperture, and creates a recess 27, or outer surface flow channel 26. This outer surface flow channel, as shown in FIG. 1, is not planar with the outer surface of the helmet cover and would direct air into vent 16". Helmet cover 12, shown in FIG. 1 comprises a outer skin 13.

FIG. 2 shows a top down view of the helmet cover shown in FIG. 1. An outer surface flow enhancer feature 26 is shown extending from the leading edge 22 of the helmet cover. The outer surface flow enhancer feature 26 has a leading width 28 that is greater than the trailing width 29. An air capture vent 67" is shown being configured at the trailing edge of the outer surface flow enhancer feature 26. In addition, both side air capture vents 67 and 67' can be seen in this view.

FIG. 3 shows a cut-away side view along line A of FIG. 2, and shows the inner surface 21, attachment features 17 and inner surface flow enhancer features 24, 24'. The attachment features 17-17", are integral extension 70 type features, having one component of a hook and loop fastener 74 attached. These tabs 72 are configured to wrap around the edge of the helmet and attach to the second hook and loop component that may be attached, such as by an adhesive, to the helmet. Two inner surface flow enhancer features 24, 24' are shown configured on the inner surface 21 of the helmet cover 12. Inner surface flow enhancer feature 24 is recessed, as indicated by the curved contour lines, and extends from the leading edge 22 of the helmet cover to the back of the helmet. Inner surface flow enhancer feature 24', a protrusion from the inner surface 21 contour, extends from the leading edge 22 of the helmet cover past a vent 16, to the trailing edge 23 of the helmet cover. In this configuration, the inner surface flow enhancer feature may increase the amount of ventilation and/or air flow to or from vents.

The impact absorbing material 14 is shown configured between the inner skin 15 and outer skin 13 in FIG. 3. As described, the thickness of the impact absorbing material may vary along the surface of the helmet cover. As shown in FIG. 3, the thickness of the impact absorbing material is relatively uniform.

FIG. 4 shows a cut-away view of an exemplary helmet cover having an attachment feature and an inner surface flow enhancer feature that may allow for air flow from the leading edge of the helmet, along the inside surface of the helmet, to the trailing edged of the helmet. The attachment feature 17 is shown extending from the back or trailing edge of the helmet and is an integral extension 70, configured as a tab 72 having one component of a hook and loop fastener 74 attached thereto. The inner surface flow enhancer feature 24 is a recessed area configured around the vent 16. The thickness of the impact absorbing material 14, varies along the contour of the helmet cover 12, with the impact absorbing material being thinner toward the edges of the helmet cover and thicker towards the top of the helmet cover.

FIG. 5 shows an isometric view of an exemplary helmet cover having interchangeable pads 46. As shown in FIG. 5, two different discrete pads 44 and 46 may be attached to the helmet cover. Discrete pad 44' is shown as a darker interchangeable pad 46', indicating that it has greater impact absorbing properties. As described, discrete pad 44' may be thicker, or have a higher density than discrete pad 44, or may comprise a different impact absorbing material. Pad recesses 48 and 48' are shown in the helmet cover for the placement of the discrete pads. The discrete pads may be placed into the recesses, as indicated by the arrows, and retained or attached to the helmet cover in any suitable way. Fasteners, tabs, integral extensions from the inner or outer skin, for example, may be used to attach a discrete pad to a helmet cover.

FIG. 6 shows an isometric view of an exemplary helmet cover 12 having a vent opening 16 configured to at least partially align with a helmet vent 19 opening in a helmet 18. An aperture 60 of the helmet cover 12, or the open area on the inner surface 62 of the helmet cover, may be configured to at least partially align with a helmet vent aperture 90, or open area on the helmet outer surface. An aligned vent may extend from the outer surface of the helmet cover to the inner surface of the helmet, thereby providing direct ventilation from the interior of the helmet to the outside of the helmet cover. Any number of aligned vents may be configured in a helmet comprising a helmet cover including, but not limited to, one or more, two or more, four or more, six or more and any range between and including the number of vents provided. In one embodiment, the helmet cover is an integral helmet cover and is a permanent part of the helmet that may be molded around at least a portion of the outer surface of a helmet. An integral helmet cover, as used herein, is permanently attached to a helmet and is not detachably attachable. A face guard 100 may be attached to the helmet or to the helmet cover in any suitable way, including as taught in U.S. Pat. No. 7,328,462 to Straus.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. An article comprising a helmet cover comprising:
a. an outer skin;
b. an impact absorbing material;
c. at least two vents;
wherein each of said at least two vents forms an aperture through said helmet cover;
wherein at least one vent is configured on a top portion of said helmet cover;
d. at least one attachment feature;
wherein said helmet cover is substantially dome shaped having;
said top portion;
two opposing side portions that extend down from said top portion;
a front portion;
a back portion;
an inner surface;
an outer surface;
wherein said helmet cover is configured to be placed over a helmet with said inner surface being configured over an outer surface of said helmet;
wherein said helmet cover is configured to be attached to said helmet by said attachment feature;
wherein the outer skin is a harder material than said impact absorbing material;
wherein the impact absorbing material is configured inside the outer skin;
wherein the helmet cover is configured to be detachably attachable to said helmet;
wherein an attachment feature comprises an integral extension of an inner or said outer skin for attaching said helmet cover to said helmet; and
wherein the integral extension comprises at least one tab having a fastener that is configured to attach to a corresponding fastener on said helmet.

2. The article of claim 1, wherein said tab is configured to extend through an aperture in said helmet.

3. The article of claim 1 wherein said tab is configured to extend around an edge of said helmet.

4. The article of claim 1, further comprising an inner skin, wherein the impact absorbing material is configured between the outer and inner skins.

5. The article of claim 1, wherein the at least one vent is an aligned vent that is configured to at least partially align with a vent in the helmet.

6. The article of claim 1, comprising at least four vents.

7. The article of claim 6, wherein the at least two vents are configured on the top portion of the helmet cover.

8. The article of claim 1, wherein at least one of the at least two vents is a tapered vent, wherein said tapered vent has a larger open area at an outer surface than at an inner surface of said helmet cover.

9. The article of claim 1, wherein a vent is a flared vent, wherein the flared vent has a smaller open area at an outer surface than at an inner surface of said helmet cover.

10. The article of claim 1, wherein a vent is an air-capture vent comprising an opening at an outer surface of said helmet cover that is non-planar.

11. The article of claim 1, wherein a helmet cover has a contoured outer surface, and wherein a vent is an air-capture vent, wherein a leading edge of said vent on an outer surface of said helmet cover is recessed from said contoured outer surface.

12. The article of claim 1, wherein the outer skin comprises plastic.

13. The article of claim 1, wherein the outer skin is an integral outer skin and comprises polyurethane.

14. The article of claim 1, wherein the impact absorbing material comprises a foam.

15. The article of claim 1, wherein the impact absorbing material comprises a polyurethane foam.

16. The article of claim 1, further comprising at least one inner surface flow enhancer feature configured on the inner surface of the helmet cover and configured to increase air flow between the helmet cover and the helmet it is attached to.

17. The article of claim 16, wherein the inner surface flow enhancer feature comprises channels extending from a leading edge of said helmet cover.

18. The article of claim 16, wherein the inner surface flow enhancer feature comprises a channel that extends from at least one of the at least two helmet cover vents, wherein airflow is configured to flow from said at least one of the at least two helmet cover vents into said channel and between the inner surface of the helmet cover and an outer surface of a helmet that is attached to.

19. The article of claim 18, wherein the channel extends from said at least one of the at least two helmet cover vents along an inner surface of the helmet cover to an edge of said helmet cover.

20. The article of claim 1, further comprising an outer surface flow channel feature comprising a recess in the outer surface of the helmet cover.

21. The article of claim 20, wherein the outer surface flow channel feature has a leading width that is larger than a trailing width.

22. The article of claim 1, wherein the helmet cover comprises at least one discrete and interchangeable pad configured to be attached to the helmet cover and form a portion of an outer surface of the helmet cover.

23. The article of claim 22, wherein the discrete and interchangeable pad has an outer perimeter and a portion of said outer perimeter of said discrete and interchangeable pad forms an edge of the helmet cover when attached to said helmet cover.

24. The article of claim 22, wherein the discrete and interchangeable pad is configured to fit within a recess of the helmet cover.

25. The article of claim 24, wherein the discrete and interchangeable pad has an outer perimeter and the entire said outer perimeter of said discrete and interchangeable pad is configured to be secured within the helmet cover recess.

* * * * *